US005510014A

United States Patent [19]

Murayama

[11] Patent Number: 5,510,014

[45] Date of Patent: Apr. 23, 1996

[54] METHOD FOR REGENERATING TIN OR TIN ALLOY ELECTROPLATING

[75] Inventor: Hiroyoshi Murayama, Tokyo, Japan

[73] Assignee: Mac Dermid, Incorporated, Waterbury, Conn.

[21] Appl. No.: 522,972

[22] Filed: Sep. 1, 1995

[30] Foreign Application Priority Data

Sep. 7, 1994 [JP] Japan ..... 6-248239

[51] Int. Cl.[6] ..... C25D 21/18

[52] U.S. Cl. ..... 205/101; 210/705

[58] Field of Search ..... 205/98, 101; 210/701, 210/705

[56] References Cited

U.S. PATENT DOCUMENTS 3,623,962 11/1971 Beale ..... 205/101

4,052,276 10/1977 Yoshida et al. ..... 205/101

4,432,844 2/1984 Hinoda et al. ..... 205/101

5,128,046 7/1992 Marbue et al. ..... 210/705

FOREIGN PATENT DOCUMENTS 55-36079 9/1980 Japan ..... 205/101

*Primary Examiner*—John Niebling
*Assistant Examiner*—Kishor Mayekar
*Attorney, Agent, or Firm*—John L. Cordani

[57] ABSTRACT

An aged tin or tin alloy plating bath is regenerated by adding a water-soluble polymer as a coagulant and a polymeric flocculant to remove sludge.

8 Claims, No Drawings

METHOD FOR REGENERATING TIN OR TIN ALLOY ELECTROPLATING

BACKGROUND OF THE INVENTION

The present invention relates to a method for regenerating a tin or tin alloy plating plate.

Plating using a tin-lead alloy plating bath is effective in improving the solderability of electric component terminals and printed circuit boards, and for this reason the demand for such plating bath is increasing.

Particularly, as such tin or tin alloy plating bath, an organic acid based bath using an alkanesulfonic acid or an alkanolsulfonic acid, or a fluoroborate based plating bath using fluoroboric acid, with a bath-soluble tin salt or a tin salt and lead salt added therein and with an assistant such as a surfactant also added therein as necessary, has recently been utilized frequently for the purpose mentioned above. However, if this tin-lead alloy plating bath is used in a continuous operation over several months, the stannous ions contained in the bath will be gradually converted into stannic oxide hydrate or stannic hydroxide by reacting with oxygen in the air, by an electrode reaction or by the catalytic reaction of copper or iron ions.

Such stannic oxide and hydroxide dissolves only a little in the bath and are gradually precipitated into the bath as sludge including insoluble organic matter contained in the bath. The sludge gives rise to problems in operation such as lowering of the tin efficiency in the electrode reaction, electrodeposition of a bump-like matter, the necessity of continuous filtration for sludge disposal from the plating bath, and increase of the bath replacement frequency.

For the purpose of suppressing the formation of sludge, various methods have been adopted such as, for example, making the organic acid concentration high, reducing the plating bath temperature, decreasing the iron or copper ion concentration, removing the precipitate by continuous filtration, and the removal of sludge using only a polymeric flocculant. However, a limit is encountered in the effect obtained by these methods.

The present invention has been accomplished in view of the above-mentioned problems and it is the object of the invention to provide a method of regenerating a plating solution by the removal of sludge in an electroplating bath which is for obtaining excellent tin plating, i.e. tin plating and tin alloy plating.

SUMMARY OF THE INVENTION

The present invention resides in a method for regenerating a tin alloy plating bath, which method comprises adding a coagulant comprising a water-soluble polymer and a polymeric flocculant to an aged, tin or tin alloy plating bath, then agitating the bath, allowing sludge to be precipitated, and separating the precipitated sludge.

DETAILED DESCRIPTION OF THE INVENTION

The present invention will be described in detail hereinunder.

A typical example of a plating bath to be regenerated according to the present invention is a tin or tin alloy plating bath using an organic acid. As the organic acid there is usually employed an alkanesulfonic acid, an alkanolsulfonic acid or a phenolsulfonic acid. The following is an example of a bath composition:

| | |
|---|---|
| Stannous methanesulfonate | 30 g/l as $Sn^{2+}$ |
| Lead methanesulfonate | 15 g/l as Pb |
| Methanesulfonic acid | 140 g/l as free acid |

An example of the plating bath other than those using organic acids is a tin, or tin alloy plating bath using fluoroboric acid, and the following is an example of a bath composition:

| | |
|---|---|
| Stannous fluoroborate | 20 g/l as $Sn^{2+}$ |
| Lead fluoroborate | 10 g/l as Pb |
| Fluoroboric acid | 150 g/l as free acid |

Into the above baths may be added conventional additives such as stabilizer, etc. In these baths it is generally presumed that sludge is formed in accordance with the following mechanism:

$$Sn^{2+} + \tfrac{1}{2} + O_2 + 2H^+ \rightarrow Sn^{4+} + H_2O \quad (1)$$

The above reaction (1) is a main reaction, in which there occur air oxidation and anodic oxidation of $Sn^{2+}$. But the following reactions are also conceivable:

$$2Fe^{2+} 1/2O_2 + 2H^+ \rightarrow 2Fe^{3+} + H_2O \quad (2)$$

$$2Cu^{+} + \tfrac{1}{2}\, O_2 + 2H^+ \rightarrow 2Cu^{2+} + H_2O \quad (3)$$

$$Sn^{2+} + 2Fe^{3+} \rightarrow Sn^{4+} + 2Fe^{2+} \quad (4)$$

$$Sn^{2+} + 2Cu^{2+} \rightarrow Sn^{4+} + 2Cu^{+} \quad (5)$$

As shown in the above formulae (2) and (3), $Fe^{2+}$ and $Cu^{+}$ are oxidized into $Fe^{3+}$ and $Cu^{2+}$, respectively, by the oxygen dissolved in the bath. Then, as shown in the above formulae (4) and (5), the said $Fe^{3+}$ and $Cu^{2+}$ are reduced in the bath into $Fe^{2+}$ and $Cu^{+}$ respectively. It is presumed that at this time $Sn^{2+}$ is oxidized into $Sn^{4+}$ to form sludge of hydrated oxide or hydroxide of tin.

The present invention is characterized in that a coagulant comprising a water-soluble polymer and a polymeric flocculant are added into such tin or tin alloy plating bath when the bath became aged, sludge was formed, the degree of organic contamination and inorganic contamination reached the limit and the bath should be replaced.

As a water-soluble polymer used as the coagulant there may be used carboxymethyl cellulose, but an anionic water-soluble polymer of low molecular weight is preferred. Examples are poly(styrene sulfonic acid alkali metal salts), alkali metal sulfonates of a copolymer of styrene and acrylic acid, methacrylic acid or maleic anhydride, polyacrylic acids or polymethacrylic acids and water-soluble alkali metal and alginic acid alkali metal salts.

These water-soluble polymers usually range in molecular weight from 1,000 to 1,200,000. More preferred examples are sodium polyacrylate (molecular weight: 10,000 to 300,000), poly(styrene sulfonate sodium salt) (molecular weight: 10,000 to 1,200,000), sodium salt of sulfonated maleic anhydride-styrene copolymer (molecular weight: 1,000 to 10,000), sulfonated polystyrene (molecular weight: 1,000 to 100,000), and sodium salt of polycarboxylic acid containing $C_5$ fraction as a main component (molecular weight: 5,000 to 10,000).

It is preferable that a portion or the whole of the water-soluble polymer used as the coagulant be added in advance of the addition of the polymeric flocculant. Usually it is added in the form of an aqueous solution. A suitable amount of the water-soluble polymer can be decided in accordance with the amount of the sludge-forming component contained in the bath, etc., but is usually in the range of 50 to 4,000 ppm.

By the addition of the water-soluble polymer and agitation it is made possible to expedite the coagulation of the sludge-forming component through lowering of its surface potential, destruction of the hydrophilic layer, etc.

As the polymeric flocculant there may be used a commercially available one, but particularly preferred is an anionic or nonionic, polymeric flocculant. Examples are copolymers of acrylamide and acrylic acid alkali metal salts or methacrylic acid alkali metal salts, and polyacrylamides, ranging in molecular weight from 5,000,000 to 15,000,000. A more preferred examples is a copolymer of acrylamide and sodium acrylate. Those having an anionic functional group, different from sodium acrylate, and generically named polyacrylamides, are also preferred.

The polymeric flocculant exemplified above may be used in a suitable amount like that in a conventional method, but usually by adding 1 to 200 ppm of the polymeric flocculant, followed by agitation, there is formed floc under crosslinking and adsorbing action between coagulated particles, which floc is precipitated rapidly. After the sedimentation, solids are separated using a suitable means such as filtration. It is also possible to re-utilize the supernatant liquid without filtration.

According to the method of the present invention, the removal of sludge from an aged tin or tin alloy plating bath can be done efficiently. Unlike inorganic salts, the water-soluble polymer used as the coagulant will neither increase the amount of ions in the plating bath nor form hydroxide gel. Therefore, the separation of sludge and reutilization of the bath can be done without essential increase in the amount of sludge. The water-soluble polymer also has the function of a dispersant, whereby the clarity of the plating bath when re-utilized can be maintained over a long period.

EXAMPLES

Example 1

A methanesulfonic acid based bright tin-lead plating bath (Sn/Pb=60/40) in about 9 months after make-up of the bath was in a brownly suspended state. As a result of analysis, the composition of the plating bath was found to be as follows:

| | |
|---|---|
| $Sn^{2+}$ | 25.0 g/l |
| Pb | 13.1 g/l |
| Free acid | 102.5 g/l |

Into this solution was then added 360 ppm of poly(styrene sulfonate sodium salt) having molecular weight of $(5\sim10)\times10^4$ as a coagulant, followed by agitation, allowing coagulation to proceed. Further added was 200 ppm of a polyacrylamide type polymeric flocculant (weakly anionic), followed by agitation, to form floc for precipitation of the suspended matter. As a result of analysis, the supernatant liquid was found to have the following composition:

| | |
|---|---|
| $Sn^{2+}$ | 17.9 g/l |
| Pb | 12.1 g/l |
| Free acid | 93.3 g/l |

The amounts of the $Sn^{2+}$, Pb and free acid were adjusted to optimum amounts and the additives were replenished. As a result, there was obtained a good result in Hull cell test. Although hydrated oxide of $Sn^{4+}$ was a main component of the floc formed, a decomposition product of the organic additives and dry film photoresist etc. were also contained therein, so by the replenishment of the additives there could be made Hull cell adjustment easily to a satisfactory extent.

In all of Examples 1 to 6, Hull cell test was conducted under the following conditions:

| | |
|---|---|
| Current | 2A |
| Time | 3 minutes |
| Temperature | 23° C. |
| Agitation | 2 m/min |

Example 2

A methanesulfonic acid based bright tin-lead plating bath (Sn/Pb=60/40) in about 6 months after make-up of the bath was in a brownly suspended state. As a result of analysis, the composition of the plating bath was found to be as follows:

| | |
|---|---|
| $Sn^{2+}$ | 15.6 g/l |
| Pb | 11.5 g/l |
| Free acid | 129.6 g/l |

Into this solution was then added as a coagulant 350 ppm of the same poly(styrene sulfonate sodium salt) having a molecular weight of $(1\sim3)\times10^4$ as that used in Example 1, followed by agitation, allowing coagulation to proceed. Further added was 10 ppm of the same polyacrylamide type polymeric flocculant as that used in Example 1, followed by agitation, to form floc for precipitation of the suspended matter. As a result of analysis, the supernatant liquid was found to have the following composition:

| | |
|---|---|
| $Sn^{2+}$ | 15.0 g/l |
| Pb | 11.5 g/l |
| Free acid | 127.2 g/l |

The amounts of the $Sn^{2+}$, Pb and free acid were adjusted to optimum amounts and then the solution was subjected to a Hull cell test, in which by replenishing the additives as necessary there could easily be obtained a good appearance of Hull cell test panel.

Example 3

A methanesulfonic acid based bright tin-lead plating bath (Sn/Pb=60/40) after bath make-up and after subsequent continuous use for about 1 year was in a brownly suspended state. As a result of analysis, the composition of the plating bath was found to be as follows:

| | |
|---|---|
| $Sn^{2+}$ | 24.8 g/l |
| Pb | 13.5 g/l |
| Free acid | 145.9 g/l |

Into this solution was then added as a coagulant 1,000 ppm of the same poly(styrene sulfonate sodium salt) as that used in Example 1, followed by agitation, and further added was 80 ppm of the same polyacrylamide type polymeric flocculant as that used in Example 1, followed by agitation, to form floc for precipitation of the suspended matter. In this case, even when 1,000 ppm of the coagulant was divided in two stages such that 600 ppm was added initially and the remaining 600 ppm was added after the addition of the polymeric flocculant, there was obtained a satisfactory effect. As a result of analysis, the supernatant liquid was found to have the following composition:

| | |
|---|---|
| $Sn^{2+}$ | 21.1 g/l |
| Pb | 13.0 g/l |
| Free acid | 138.0 g/l |

The amounts of the $Sn^{2+}$, Pb and free acid were adjusted to optimum amounts and then the solution was subjected to a Hull cell test, in which by replenishing the additives as necessary there could easily be obtained a good appearance of Hull cell test panel.

According to a supernatant liquid removing method, the recovery of the plating solution was about 70% by volume. The polymeric flocculant is absorbed to the sludge side, while the coagulant is presumed to remain in an unnegligible amount in the recovered plating solution because it was added as much as 1,000 ppm. The water-soluble polymer as the coagulant does not exert any adverse effect on plating. Besides, it is usually employed as a dispersant for inorganic salts, so when remaining in the plating solution, it also exhibits the effect of suppressing the particle growth of the resulting hydrated oxide of tin and thereby preventing the plating solution from becoming turbid.

Example 4

A methanesulfonic acid based bright tin-lead plating bath (Sn/Pb=95/5) after make-up of the bath and after subsequent continuous use for about 10 months was a brownly suspended state. As a result of analysis, the composition of the plating bath was found to be as follows:

| | |
|---|---|
| $Sn^{2+}$ | 17.6 g/l |
| Pb | 0.9 g/l |
| Free acid | 139.0 g/l |

Into this solution was then added as a coagulant 500 ppm of the same poly(styrene sulfonate sodium salt) as that used in Example 1, followed by agitation, and further added was 40 ppm of the same polyacrylamide type polymeric flocculant as that used in Example 1, followed by agitation, to form floc for precipitation of the suspended matter. In this case, even when 500 ppm of the coagulant was divided in two stages such that 400 ppm was added initially and the remaining 100 ppm was added after the addition of the polymeric flocculant, there was obtained a satisfactory effect. As a result of analysis, the supernatant liquid was found to have the following composition:

| | |
|---|---|
| $Sn^{2+}$ | 16.2 g/l |
| Pb | 0.9 g/l |
| Free acid | 138.1 g/l |

The amounts of the $Sn^{2+}$, Pb and free acid were adjusted to optimum amounts and then the solution was subjected to a Hull cell test, in which by replenishing the additives as necessary there could easily be obtained a good appearance of Hull cell test panel.

Example 5

A methanesulfonic acid based bright tin-lead plating bath (Sn/Pb=60/40) after make-up of the bath and after subsequent continuous use for about 9 months was in a brownly suspended state. As a result of analysis, the composition of the plating bath was found to be as follows:

| | |
|---|---|
| $Sn^{2+}$ | 25.2 g/l |
| Pb | 11.5 g/l |
| Free acid | 142.1 g/l |

Into this solution was then added as a coagulant 100 ppm of polystyrene sulfonic acid (molecular weight: 70,000) , followed by agitation, allowing coagulation to proceed. Further added was 80 ppm of a polyacrylamide type polymeric flocculant (weakly anionic), followed by agitation, to form floc for precipitation of the suspended matter. After standing overnight, the supernatant liquid was transparent, and as a result of analysis, it was found to have the following composition:

| | |
|---|---|
| $Sn^{2+}$ | 23.3 g/l |
| Pb | 11.3 g/l |
| Free acid | 139.2 g/l |

The amounts of the $Sn^{2+}$, Pb and free acid were adjusted to optimum amounts and additives was replenished. As a result, there was obtained a good result in Hull cell test. According to a supernatant liquid removing method, the recovery of the plating solution was about 70% by volume.

Example 6

A methanesulfonic acid based bright tin-lead plating bath (Sn/Pb=60/40) after make-up of the bath and after subsequent continuous use for about 12 months was in a brownly suspended state. As a result of analysis, the composition of the plating bath was found to be as follows:

| | |
|---|---|
| $Sn^{2+}$ | 17.3 g/l |
| Pb | 7.3 g/l |
| Free acid | 118.1 g/l |

Into this solution was then added as a coagulant 800 ppm of sodium sulfonate of a maleic anhydride-styrene copolymer, (molecular weight: 7,000 to 8,000), followed by agitation, allowing coagulation to proceed, and further added was 60 ppm of a polyacrylamide type polymeric flocculant (weakly anionic), followed by agitation, to form floc for precipitation of the suspended matter. After standing overnight, the supernatant liquid was transparent, and as a result of analysis, it was found to have the following composition:

| | |
|---|---|
| $Sn^{2+}$ | 16.0 g/l |
| Pb | 7.1 g/l |
| Free acid | 109.4 g/l |

The amounts of the $Sn^{2+}$, Pb and free acid were adjusted to optimum amounts and then the solution was subjected to a Hull cell test, in which by replenishing the additives as necessary there could easily be obtained a good appearance of Hull cell test panel. According to a supernatant liquid removing method, the recovery of the plating solution was about 70% by volume.

What is claimed is:

1. A method for regenerating a tin or tin alloy electroplating bath, which method comprises adding a coagulant comprising a water-soluble polymer and a polymeric flocculant to an aged tin or tin alloy electroplating bath containing sludge, then agitating the bath, allowing the sludge to coagulate with the coagulant and form a floc sludge to be precipitated, and separating the precipitated floc.

2. A method as set forth in claim 1, wherein the electroplating bath is an organic acid based plating bath.

3. A method as set forth in claim 2, wherein the organic acid is an alkanesulfonic acid, an alkanosulfonic acid or a phenolsulfonic acid.

4. A method as set forth in claim 1, wherein the electroplating bath is a fluoroborate based plating bath.

5. A method as set forth in any of claims 1 to 4, wherein the coagulant is an anionic, water-soluble polymer having a molecular weight in the range of 1,000 to 1,200,000.

6. A method as set forth in claim 1, wherein the water-soluble polymer is at least one member selected from the group consisting of polystyrene sulfonic acid alkali metal salts, alkali metal sulfonates of a copolymer of styrene and acrylic acid, methacrylic acid or maleic anhydride, polyacrylic acid, polyacrylic acid alkali metal salts, polymethacrylic acid, polymethacrylic acid alkali salts, and alginic acid alkali metal salts.

7. A method as set forth in any of claim 5, wherein the polymeric flocculant is an anionic or nonionic, polymeric flocculant.

8. A method as set forth in any of claim 5, wherein the polymeric flocculant is a copolymer of acrylamide and sodium acrylate or sodium methacrylate, or a polyacrylamide, and has a molecular weight of 5,000,000 to 15,000,000.

* * * * *